US010870046B2

(12) United States Patent
Franklin

(10) Patent No.: US 10,870,046 B2
(45) Date of Patent: Dec. 22, 2020

(54) WORKOUT COUNTING DEVICE

(71) Applicant: Victor Lee Franklin, Corsicana, TX (US)

(72) Inventor: Victor Lee Franklin, Corsicana, TX (US)

( * ) Notice: Subject to any disclaimer, the term of this patent is extended or adjusted under 35 U.S.C. 154(b) by 0 days.

(21) Appl. No.: 16/263,003

(22) Filed: Jan. 31, 2019

(65) Prior Publication Data

US 2019/0232148 A1 Aug. 1, 2019

Related U.S. Application Data

(60) Provisional application No. 62/624,471, filed on Jan. 31, 2018.

(51) Int. Cl.
*A63B 71/06* (2006.01)
*A63B 23/04* (2006.01)

(52) U.S. Cl.
CPC ..... *A63B 71/0622* (2013.01); *A63B 23/0405* (2013.01); *A63B 2023/0411* (2013.01); *A63B 2071/0625* (2013.01); *A63B 2220/17* (2013.01); *A63B 2225/093* (2013.01)

(58) Field of Classification Search
CPC ..... A63B 71/0622; A63B 23/0405; A63B 2023/0411; A63B 2220/17; A63B 2071/0625; A63B 2225/093; A63B 1/00
See application file for complete search history.

(56) References Cited

U.S. PATENT DOCUMENTS 5,108,095 A * 4/1992 Nichols ..... A63B 21/0615 482/137
7,874,958 B1 * 1/2011 Ramsey, Sr. ..... A63B 23/0405 482/8
9,662,536 B1 * 5/2017 Lin ..... A63B 23/0405
2010/0041516 A1 * 2/2010 Kodama ..... A63B 24/0062 482/8
2012/0238418 A1 * 9/2012 Reyes ..... A63B 21/0615 482/121
2013/0324374 A1 * 12/2013 Ellis ..... A63B 21/1609 482/97
2014/0066275 A1 * 3/2014 Miller, Jr. ..... A63B 21/00047 482/142
2015/0265872 A1 * 9/2015 Sela ..... A63B 23/0405 482/133
2016/0175645 A1 * 6/2016 Rayman ..... A63B 21/068 482/131
2016/0346586 A1 * 12/2016 Pullins ..... A63B 23/0405
(Continued)

*Primary Examiner* — Sundhara M Ganesan
(74) *Attorney, Agent, or Firm* — Wilson Daniel Swayze, Jr.

(57) ABSTRACT

The present invention discloses an exercise device that is used to perform squat exercise. The device comprises a support bar, a height-adjustable support tube or column, a base, an electronic unit, and a seat. The support bar is positioned on a top portion of the support tube via a set of springs. The sprigs are configured to reposition the support bar to a horizontal position after the user leaves the seat and rises back into the upright body position. The electronic unit is configured to receive a set threshold value on maximum squat count from a user. The electronic unit records the squat count and provide an alert when the squat count exceeds the set threshold value on maximum squat count to be performed by the user, thereby it prevents injuries caused due to over enthusiastic during the exercise session.

19 Claims, 7 Drawing Sheets

(56) References Cited

U.S. PATENT DOCUMENTS

| | | | | |
|---|---|---|---|---|
| 2016/0346617 | A1* | 12/2016 | Srugo | G09B 19/0038 |
| 2017/0087402 | A1* | 3/2017 | Chen | A63B 21/0615 |
| 2017/0165522 | A1* | 6/2017 | James | A63B 71/06 |
| 2017/0203149 | A1* | 7/2017 | D'Amico | A63B 21/4009 |
| 2018/0036589 | A1* | 2/2018 | Lin | A63B 21/00181 |
| 2018/0064992 | A1* | 3/2018 | Rothman | H04N 7/188 |
| 2019/0143176 | A1* | 5/2019 | Wilson | A63B 21/00185 434/247 |
| 2019/0314677 | A1* | 10/2019 | Rayman | A63B 21/00181 |
| 2020/0009421 | A1* | 1/2020 | Ku | A63B 21/4035 |

* cited by examiner

WORKOUT COUNTING DEVICE

BACKGROUND OF THE INVENTION

A. Technical Field

The present invention generally relates to a device designed for exercise. More specifically, the present invention relates to a device used for counting leg and hip muscles exercise employing squat maneuvers.

B. Description of Related Art

Exercise is necessary to maintain good health and mental sharpness. Physical exercise is performed for various reasons, including improving the cardiovascular system, athletic skills, weight loss, reducing the effects of aging, muscle strength, and a continuing variety of skills and health improvements brought on by the impact of good and effective physical exercise. Studies have shown that frequent and regular physical exercise plays a major role in maintaining a healthy life. Regular exercise has proven to be beneficial for human body as it boosts the immune system, improve sleep habits, prevents the chances of occurrence of life-threatening diseases like diabetes, high blood pressure etc.

The human body also requires rests for a proper functioning of the body. However, too much exercise could cause detrimental effects on the human body resulting in severe complications and health risks. The human body has certain natural boundaries or capacity, and exercising beyond these boundaries is dangerous. Exercising the body without rest could cause damage to muscle and muscle groups. Further, overtraining beyond the body's capacity to recover, does more harm leading to permanent injury.

In addition to the side effects caused due to over exercise, the body could even suffer from side effects occurring due to performing improper exercise technique and workouts. For many activities such as running and cycling, there are significant injuries that occurs due to poorly regimented exercise schedules. Squatting and deep knee bends are easy exercises that benefits the legs, knees, glutes, hamstrings, claves and several other areas of the human body. While performing squats or deep knee bend exercise it is easy to over-extend and bend down. However, bending too low creates stress on the muscles and cartilage resulting in injury. The injuries caused to the knees, joints, as well as other vital areas of the body, may be due to improper performance of deep knee bends and squats.

Further, an exerciser or an individual performing exercise has to count the number of squats in their head or have a co-exerciser count the cycles for them. If the exerciser is interrupted, or inadvertently makes a miscount, they must restart at some arbitrary count or begin the exercise again. This creates discomforting, and negatively affect the exercise routine of the individual. Additionally, the individual has to maintain a notebook or manually enter on the user communication device, to note the repetitions they accomplished in the past.

In light of the forgoing discussion, there is a need for a device that resolves the aforementioned problem and prevents injury, and promotes safe and effective exercising. Further, there is a need of a device that monitors the activity of the individual while performing an exercise, and stores the exercising history of the individual for future reference.

SUMMARY OF THE INVENTION

The present invention relates to an exercise device. The device is used for the prevention of overextending when performing squats or deep knee bends during physical exercise.

According to the present invention the device prevents overextending, while performing squats or deep knee bend during physical exercise. The device comprises a support bar, a height-adjustable support tube or column, a base, an electronic unit, and a seat. In one embodiment, the device is made of a material, but not limited to, steel. The device is configured to tilt down when a posterior of a user is in contact with the seat. The support bar at a top portion of the support tube is held horizontal by at least one spring, which allows the support bar to tilt when contacted by the posterior of the user. The support bar provided at the top portion of the support tube is held horizontal by at least one spring that allow the support bar to tilt when contacted by the posterior of the user, when the safest lower extension is reached on performing deep knee bend or squats.

In an embodiment, the at least one spring used in the present invention is, for example, but not limited to, a pair of return spring or a torsion spring. In one embodiment, the pair of return springs could be engaged to the support bar at one and to the support tube on the other end. The return springs allow the support bar to tilt, when contacted by the posterior of the user. Further, the return springs force the support bar to return to the horizontal position as the posterior of the user leaves the seat. Further, special break-away springs are provided to prevent over-stressing and prevent injuries. In an embodiment, the set of springs used for tilting the support bar is a torsion spring.

In one embodiment, the support bar comprises a first end and a second end. In one embodiment, the seat is positioned on the first end and the electronic unit positioned on the second. In one embodiment, the electronic unit configured to receive a set threshold value on maximum squat count from a user. In one embodiment, the electronic unit records the squat count and provide an alert when the squat count exceeds the set threshold value on maximum squat count to be performed by the user, thereby it prevents injuries caused due to over enthusiastic during the exercise session. The electronic unit also tracks the number of repetitions of the squats performed by the user during the exercise session. The alert is at least one of an audio alert, a voice message alert, and a vibration alert. The electronic unit further comprises a menu driven program to count the number of squats performed by the user during the exercise session. The electronic unit counts, tracks, and records each squat count cycle of the exercise session, and compares it with a pre-programmed desired number of squat count cycles.

In one embodiment, the electronic unit comprises a user interface. In one embodiment, the user interface could be, but not limited to, a touchscreen. In one embodiment, the electronic unit is configured to communicate with a user communication device via a wireless communication. In one embodiment, the user communication device is at least one of, but not limited to, a smartphone or tablet, PDA, a smart watch, an iPod, and a laptop. In one embodiment, the wireless communication includes at least one of Wi-Fi, WLAN, infrared, radio waves, and Bluetooth®. An application such as workout-counting device (WCD) application installed in the user communication device that enables the user to program the electronic unit. The application is maintained and made available free of charge, when the device is purchased. The application could also be downloaded via a link in the manufacturer's Internet store. The user could reset and program new parameters such as, but not limited to, number of squat cycles to be performed before starting the exercise session Further, the data accumulated in the exercise session is stored in the electronic module. The user could download the stored data to the user communication device, via the wireless communication.

In an embodiment, the support tube comprises an upper tube and a lower tube. The lower tube is cut to length and has one or more holes cut through to accept a height adjustment pin such as but not limited to a bent shaft quick release pin or a quick release pin. Further, the upper tube is cut to length, wherein the upper tube has a plurality of holes to fit the height adjustment pin cut on 1" centers along the full length of the tube. The upper tube is configured to extend upwardly from the lower tube and secured at a desired height by fixing the height adjustment pin into holes of the upper and lower tube. The support tube is a simple telescoping column having height adjustment feature, which is held in place by the height adjustment pin. In an embodiment, an L shaped restraint, or section is cut from the square tubing. The L-shaped section is placed in a jig, and is robotically welded to the top of the upper tube. The L-shaped section serves as a mounting rectangle for the support tube and a stop, such as but not limited to a rubber stop, to prevent over rotation beyond horizontal. The base is configured to accommodate the support tube.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
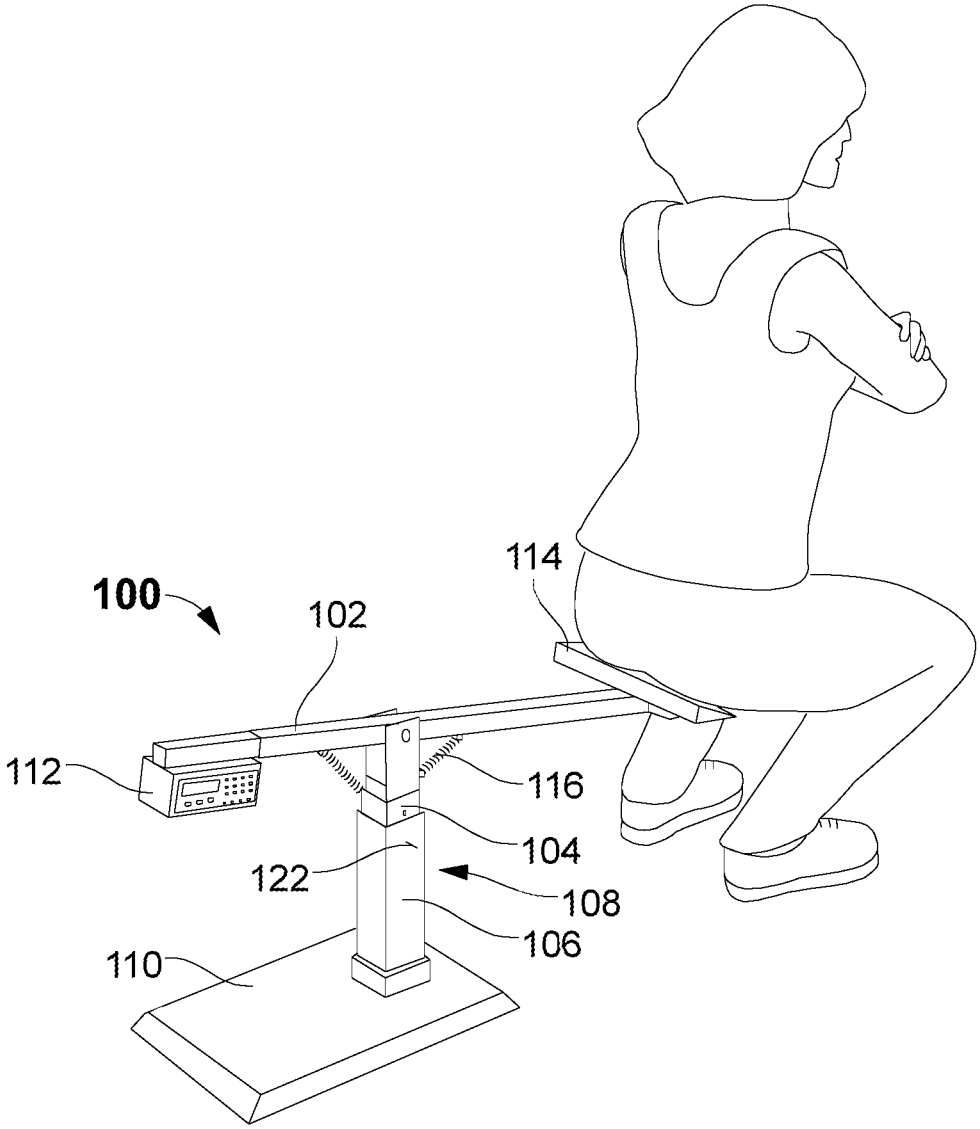
FIG. 1 is a perspective view illustrating a user sitting on a device, according to an embodiment, of the present invention.

Referring to FIG. 1 is a perspective view illustrating a user sitting on a device 100 according to an embodiment, of the present invention. The device 100 is a workout-counting device or exercise device that prevents overextending, while performing squats or deep knee bend during physical exercise. In an embodiment, the device 100 comprises a support bar 102, a height-adjustable support tube or column 108, a base 110, an electronic unit 112, and a seat 114. The device 100 is configured to tilt down when a posterior or buttocks of the user is in contact with the seat 114. In one embodiment, the seat 114 is configured to support at least one user. In an embodiment, the support bar 102 is fabricated from a smaller size bar than the upper tube 104, and has a mounting hole machined through it to permit a ⅜" diameter bolt to be fed through the upper tube 104, and the support tube 108. This bolt acts as a pivot for the support tube 108 and further supports the torsion return spring 118.

The support bar 102 provided at the top of the support tube 108 is held in a horizontal position by at least one spring that allow the support bar 102 to tilt when contacted by the posterior of the user, when the safest lower extension is reached on performing deep knee bend or squats. In an embodiment, the at least one spring used in the present invention is, for example, but not limited, to a pair of return springs 116, or a torsion spring 118. The return springs 116 are engaged to the support bar 102 at one and to the support tube 108 on the other end. The return springs 116 allow the support bar 102 to tilt, when contacted by the posterior of the user. Further, the return springs 116 force the support bar 102 to return to the horizontal position as the posterior of the user leaves the seat 114. Further, special breakaway springs are also provided to prevent over-stressing and injuries.

In an embodiment, the seat 114, and the electronic unit 112 are mounted on the first and second end of the support bar 102 respectively. The seat 114 is positioned one end of the support bar 102 and the electronic unit 112 at the other end. The seat 114 facilitates the user to rest the posterior while performing the physical exercise, such as but not limited to squats and deep-kneed bend exercise. The seat 114 is fabricated using a rectangular section of 0.5" thick plywood, which is covered with a foam material. The foam material for example is but not limited to ethyl vinyl acetate (EVA). The foam and the plywood are covered with a thick layer of synthetic leather. The synthetic layer provides a lightweight and elegant look to the seat 114 such as a striker plate. The soft surface of the seat 114 cushions the impact of the buttocks or posterior of the user as it contacts the seat 114 on the support bar 102. The color of synthetic leather could be selected to be matching, contrasting, or complementing the device 100 paint color. In one embodiment, the electronic unit 112 is configured to receive a set threshold value on maximum squat count from a user. In one embodiment, the electronic unit 112 records the squat count and provide an alert when the squat count exceeds the set threshold value on maximum squat count to be performed by the user, thereby it prevents injuries caused due to over enthusiastic during the exercise session. In one embodiment, the alert is at least one of, but not limited to, an audio alert, a voice message alert, and a vibration alert. The electronic unit 112 also tracks the squats count performed by the user during the exercise session.

Figure 6A:
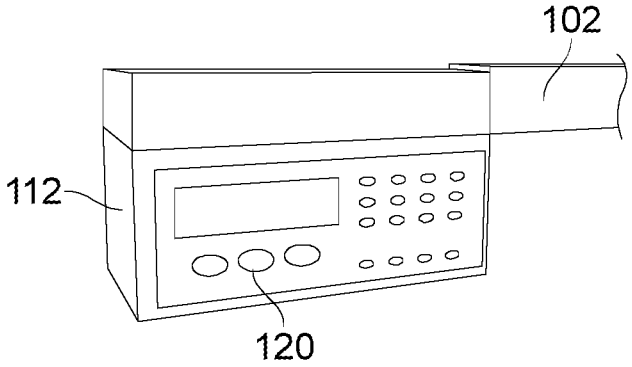
FIG. 6A is a perspective view of an electronic unit, according to an embodiment, of the present invention.

Referring to FIG. 6A is a perspective view of the electronic unit 112 mounted on the support bar 102, according to an embodiment, of the present invention. In one embodiment, the electronic unit 112 is positioned on the second end of the support bar 102. The electronic unit 112 is housed in an enclosure. The enclosure is a plastic enclosure for example but not limited polycarbonate acrylonitrile-butadiene-styrene (ABS) plastic enclosure. In an embodiment, the enclosure could be made of any material, such that it serves the purpose of the present invention. The enclosure has a T-shaped mount on the top that slides into a slot cut into a bottom of the support tube 108. In one embodiment, the electronic unit 112 comprises a user interface. In one embodiment, the user interface could be, but not limited to, a touchscreen. In one embodiment, the electronic unit 112 employs a menu driven program to count the number of movements caused by the user's gluteus maximus pushing the cushioned seat 114 down as the user squats. In an embodiment, the electronic unit 112 counter is configured to communicate with a user communication device and engage any of the menu-driven functions. An application such as workout-counting device (WCD) application installed in the user communication device enables the user to program the electronic unit 112 via a wireless communication such as, but not limited to, Wi-Fi, WLAN, infrared, radio waves, and Bluetooth®. The application is maintained and made available free of charge when the device 100 is purchased. The application could also be downloaded via a link in the manufacturer's Internet store. The user could reset and program new parameters, such as but not limited to number of squat cycles to be performed, before starting the exercise session.

Figure 6B:
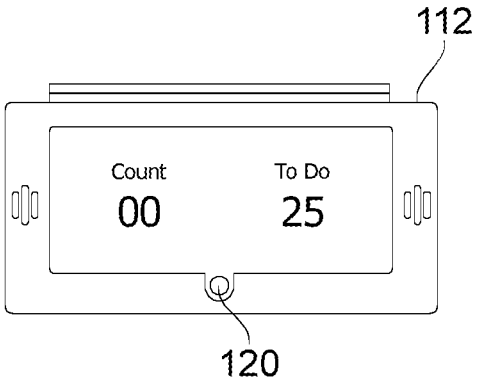
FIG. 6B exemplary illustrates the electronic unit displaying the number of counts performed and total number of counts to be performed by the user, in an embodiment of the present invention.

Referring to FIG. 6B exemplary illustrates the electronic unit 112 displaying the number of counts performed and total number of counts to be performed by the user, in an embodiment of the present invention. In an electronic unit 112 counts, tracks a record of each cycle of the exercise session performed by the user, and compares it with a pre-programmed desired number of squats count. The device 100 could provide an alert to notify or warn the user in response to exceeds the set threshold value on maximum squat count during the exercise session. The alert signal could be, but not limited to, an audio alert, a voice message, and a vibration alert. Further, the data accumulated in the exercise session is stored in the electronic module 112. The user could download the stored data to the user communication device via the wireless communication such as, but not limited to, Wi-Fi, WLAN, infrared, radio waves, and Bluetooth®. An on/off button or switch provided 120, on the electronic unit 112 engages to the user interface so that the menu driven program is displayed.

Figure 6C:
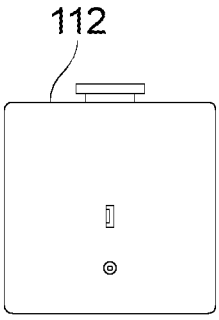
FIG. 6C exemplary illustrates a view of the electronic unit illustrating an USB support port, according to an embodiment of the present invention.

Referring to FIG. 6C exemplary illustrates a view of the electronic unit 112 with a USB support port according to an embodiment, of the present invention the electronic unit 112 could be recharged using a supplied AC adapter and 6' cord. In an embodiment, the electronic module 112 is charged based upon a request by the user interface, and an alert generated by the electronic unit 112. Further, the USB port support provided in the electronic unit 112 enables the user to connect the user communication device to the electronic unit 112 irrespective of Bluetooth/Wi-Fi connectivity, if required. The electronic unit 112 counter is fabricated using, but not limited to, the following.

| Description | Specification |
|---|---|
| Display | LED-backlit, 4" diagonal, capacitive touchscreen, 16M colors, with Gorilla glass, & oleophobic coating |
| Chipset | Dual core 1.3 GHz ARM v7 |
| Memory | 1 GB of RAM & 16 GB SSDR |
| Sound | 16-bit, 44.1 kHz audio |
| Communications | WiFi 802.11 a/b/g/n, Bluetooth 4.0 |
| Sensors | Accelerometer, gyrometer |
| Audio | Proprietary alert tones & synthesized speech |
| Loudspeakers | 66 dB audio maximum |
| Battery (rechargeable) | 1440 mAHr |
| Recharger | 120 VAC to 5 VDC with 6' polarized cord |
| Connectors | USB 2.0 reversible, 5.0 VDC charger |

In an embodiment, a printed circuit board (PCB) for the electronic unit 112 is fabricated to the final assembler's requirements. The standard thickness, double-sided FR4 circuit board material is populated with surface mounted components. After the soldering and the cleaning of the surface mounted assembly, any through-hole devices and displays are inserted. The circuit board is designed to have all the components oriented for mounting the circuit board with LED illuminators and display unit projecting out of the lenses mounted in the housing. After assembly, the PCBs are protected with a coating. The coating provided is moisture adsorption preventive conformal coating.

Figure 3:
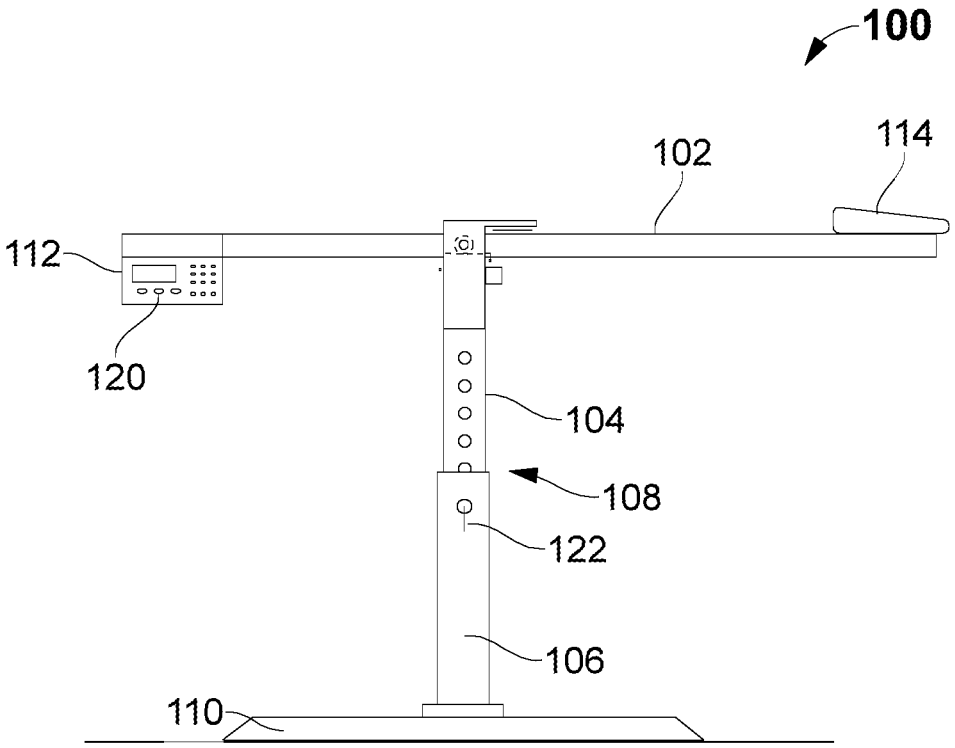

In an embodiment, the support tube 108 comprises an upper tube 104 and a lower tube 106. The support tube 108 is a square tubing supplied in 20' long sticks with the lower tube 106 (larger tube) accepting an upper tube 104 (small sized tube) after machining The lower tube 106 is cut to length and has one or more holes cut through to accept a height adjustment pin 122 such as but not limited to a bent shaft quick release pin or a quick release pin. Further, the upper tube 104 is cut to length wherein the upper tube 104 has a plurality of holes to fit the height adjustment pin 122 cut on 1" centers along the full length of the tube. In one embodiment, the upper tube 104 is configured to extend upwardly from the lower tube 106 and secured at a desired height by fixing a height adjustment pin 122 into holes of the upper and lower tube (104 and 106). In another embodiment, the square tube 108 is a simple telescoping column having height adjustment feature, which is held in place by the height adjustment pin 122. The height adjustment feature of the support tube 108 helps in accommodating individuals of varying height. Referring to FIG. 3 exemplary illustrates a full height elevation of the device 100, according to an embodiment of the present invention.

Figure 2:
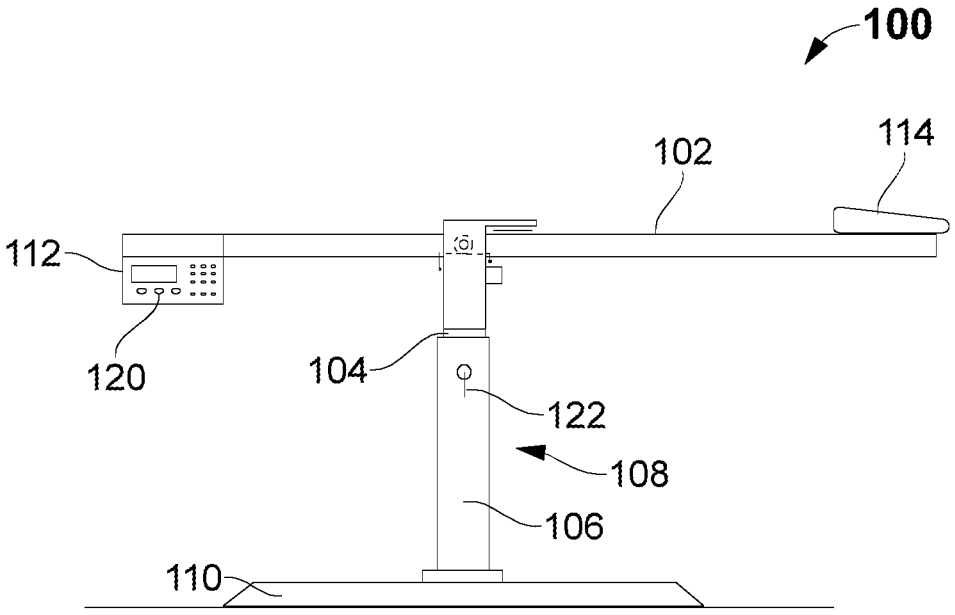
FIG. 2 exemplary illustrates the device at a lowest height elevation, according to embodiment of the present invention FIG. 3 exemplary illustrates a full height elevation of the device, according to an embodiment of the present invention.
Figure 5A:
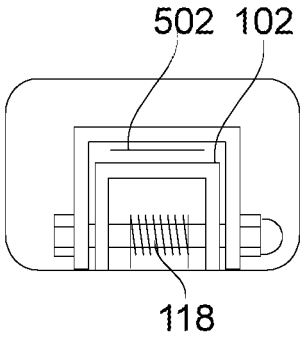
FIG. 5A exemplary illustrates a top sectional view of the device, according to an embodiment of the present invention.
Figure 5B:
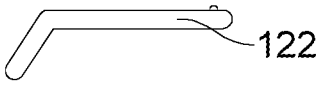
FIG. 5B is a view of a height adjustment pin, according to an embodiment of the present invention.

Referring to FIG. 5B is a view of the height adjustment pin 122, according to an embodiment of the present invention. In an embodiment, the height of the support tube 108 is adjusted from the 17" median height using the height adjustment pin 122. The height adjustment pin 122 is the bent shaft quick release pin. The bent shaft pin 122 is commercially available and has a spring load ball bearing at the end of the shaft. The ball bearing is forced into the shaft of the pin. The ball bearing prevents the pin from coming out under normal vibration encountered during use. The pin is nickel plated to prevent rusting and corrosion. Referring to FIG. 2 exemplary illustrates the device 100 at a lowest height elevation, according to an embodiment of the present invention.

In an embodiment, the base 110 is configured to accommodate the support tube 108. The lower tube 106 is engaged to the base 110. The base 110 is cut from 0.5" thick cold rolled steel. The angle of the sides and the rounded corners are formed as part of the cutting process. The water jet does not create a burr during the cutting process so each of the components are ready for cleaning and coating coming out of the machine center. The size of the base 110 could vary accordingly. In an embodiment, the support tube 108, the base 110, an L-shape restraint, the support bar 102 are made of steel components. The steel components are fabricated from various steel stock, which is fed into the CNC water jet-machining center. The steel components are powder coated and thermally cured to provide a very durable, scratch and corrosion resistant surface. The device 100 could be supplied in any vibrant color, so a distinctive color could be chosen to enhance the device 100 recognition factor to improve the market adoption of the device 100.

Figure 4A:
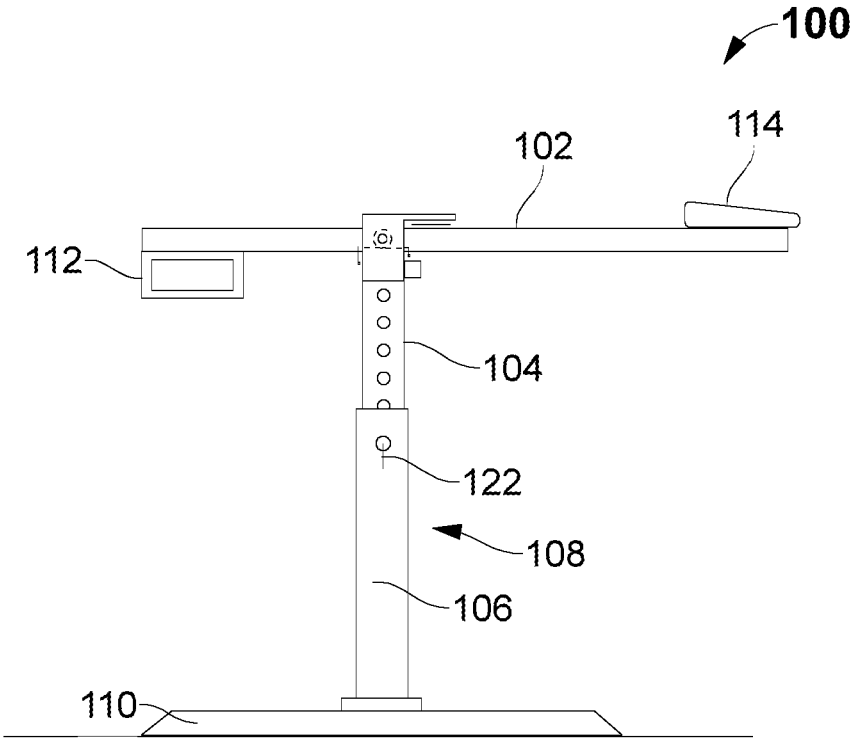
FIG. 4A exemplary illustrates a side view of the device, according to an embodiment of the present invention.

Referring to FIG. 4A exemplary illustrates a side view of the device 100, according to an embodiment of the present invention. The steel base 110 is cut to shape on a water jet-machining center making a tapered shape and rounded corners. The lower tube 106 is welded to the steel base 110 and the bead hidden using a decorative cover. In an embodiment, the decorative cover is a plastic decorative cover. However, the decorative cover could be of any material that serves the purpose of the present invention. The electronic unit 112 includes one or more sensors to determine the movement and detect a 2.5-degree shift. The actual minimum angle discrimination is less than 0.5° but the detection is algorithm damped to ensure that multiple movements from inadvertent shaky touching during strokes are counted as only one contact. The height of the support tube 108 is set to detect and record even the deepest squat performed. The previous data recorded and the current exercise session parameters could be set via the application installed in the user communication device via the wireless communication.

In an embodiment, the L-shaped restraint or section is cut from the square tubing. The L-shaped section is placed in a jig, and is robotically welded to the top of the upper tube 104.The L-shaped section serves as a mounting rectangle for the support tube 108 and a stop 502 such as but not limited to a rubber stop, to prevent over rotation beyond horizontal. After painting, a high-density ethyl vinyl acetate (EVA) foam pad is placed inside the L-shaped section to cushion the support tube 108 as it returns to the horizontal plane.

Figure 4B:
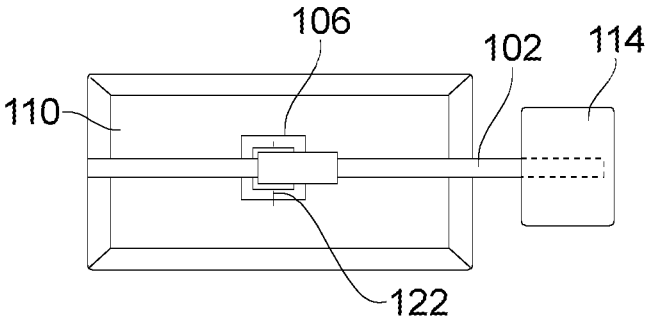
FIG. 4B exemplary illustrates a top view of the device, according to an embodiment of the present invention.

Referring to FIG. 4B exemplary illustrates a stop view of the device 100, according to an embodiment of the present invention. In one embodiment, the electronic unit 112 record the squat count during the exercise session and provide an alert when the squat count exceeds the threshold value on maximum squat count to be performed by the user. Referring to FIG. 5A exemplary illustrates a top sectional view of the device 100, according to an embodiment of the present invention. The support bar 102 pivots on a ⅜" diameter bolt that penetrates the side tubing, and is restored to the normal position using the torsion spring 118 after contact with the users posterior or buttocks. The device 100 disclosed in the FIG. 4A use the torsion spring 118 to facilitate the tilting of the device 100, and return back to the horizontal position.

Figure 7A:
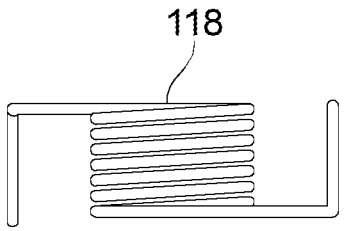
FIG. 7A exemplary illustrates a top view of a torsion spring according to an embodiment of the present invention.
Figure 7B:
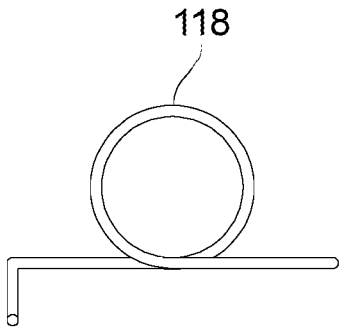
FIG. 7B exemplary illustrates a side view of the torsion spring, according to an embodiment of the embodiment.

Referring to FIG. 7A exemplary illustrates a top view of the torsion spring 118, according to an embodiment of the present invention. In an embodiment, the set of springs used for tilting the support bar 102 is a torsion spring 118. The commercially available torsion spring 118 is wound using 0.135" diameter steel music wire, which has a 40 inch-pound torque capability that easily returns the unloaded support bar 102 to the horizontal position. The torsion spring 118 is concealed within the support tube 108 except for the spring ends, providing a cleaner looking product without any pinch points. Referring to FIG. 7B exemplary illustrates a side view of the torsion spring 118, according to an embodiment of the embodiment. The pin of the torsion ring 118 is nickel plated to prevent rusting and corrosion during use. The rugged music wire wound torsion spring 118 has a restoring force that is capable of returning support bar 102 to the horizontal position after the user's gluteus maximus leaves the seat 114 and rises back into the upright body position. The torsion spring 118 works quietly and has an exceptionally long product life.

In an embodiment, the device 100 is easy to operate. The height of the device 100 is adjusted according to the need of the user. The electronic unit 112 detects as the support bar 102 is tilted. The electronic unit 112 provides an alert to the user in response to exceeds the set threshold value on maximum squat count during the exercise session. The electronic unit 112 also tracks the number of repetitions of the squats performed by the user during the exercise session. The device 100 employs special breakaway springs to prevent over-stressing and prevent injuries. The device has a soft seat 114 allowing the user to contact the device 100, by placing the posterior of the user on the seat 114. The electronic unit 112 is powered by a battery, and is wirelessly connected to the user communication device. The device 100 promotes a safe, effective and safe exercising. The device 100 is sturdy and durable, which could be used by the user for several years.

Preferred embodiments of this invention are described herein, including the best mode known to the inventors for carrying out the invention. It should be understood that the illustrated embodiments are exemplary only and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

What is claimed is:

1. An exercise device for performing squats, comprises:

a base;

a height-adjustable support column attached to the base;

a support bar having a first end and a second end, wherein the support bar is pivotally mounted on a top portion of the support column;

a seat positioned on the first end of the support bar;

an electronic unit positioned on the second end of the support bar configured to receive a set threshold value on maximum squat count from a user, wherein when the user performs squat exercise on the seat, the electronic unit is configured record the squat count and provide an alert when the squat count exceeds the set threshold value on maximum squat count to be performed by the user, thereby it prevents injuries caused due to over enthusiastic during the exercise session.

2. The device of claim 1, wherein the support bar is held horizontally to the support column via at least one spring.

3. The device of claim 2, wherein the at least one spring is configured to reposition the support bar to a horizontal position after the user leaves the seat, and rises back into the upright body position.

4. The device of claim 2, wherein the at least one spring is at least one of a return spring and a torsion spring.

5. The device of claim 1, wherein the support column comprises an upper tube and a lower tube, wherein the upper tube is configured to extend upwardly and secured at a desired height by fixing a height adjustment pin into holes of the upper and lower tube.

6. The device of claim 1, is made of steel.

7. The device of claim 1, wherein the seat is configured to support at least one user.

8. The device of claim 1, wherein the electronic unit is configured to count the number of squats performed by the user during the exercise session.

9. The device of claim 1, wherein the electronic unit comprises a user interface, wherein the user interface is a touchscreen.

10. The device of claim 1, wherein the electronic unit comprises a menu driven program to count the number of squats.

11. The device of claim 1, wherein the electronic unit is configured to communicate with a user communication device via a wireless communication.

12. The device of claim 11, wherein the user communication device is at least one of a tablet, a smartphone, a personal digital assistant (PDA), a smart watch, and a laptop.

13. The device of claim 11, wherein the wireless communication includes at least one of Wi-Fi, WLAN, infrared, radio waves, and Bluetooth®.

14. The device of claim 1, wherein the alert is at least one of an audio alert, a voice message alert, and a vibration alert.

15. An exercise device for performing squats, comprises:

a base;

a height-adjustable support column attached to the base;

a support bar having a first end and a second end, wherein the support bar pivotally mounted on a top portion of the support column;

a seat positioned on the first end of the support bar;

an electronic unit positioned on the second end of the support bar configured to receive a threshold value on maximum squat count from a user, wherein when the user performs squat exercise on the seat, the electronic unit is configured to record the squat count and provide alert when the squat count exceeds the threshold value on maximum squat count to be performed by a user, thereby it prevents injuries caused due to over enthusiastic during the exercise session.

16. The device of claim 1, wherein the height-adjustable support column comprises an upper tube and a lower tube, wherein the upper tube is configured to extend upwardly and secured at a desired height by fixing a height adjustment pin into holes of the upper and lower tube.

17. The device of claim 1, wherein the electronic unit comprises a menu driven program to count the number of squats performed by the user during exercise session.

18. The device of claim 1, wherein the electronic unit is configured to detect tilting of the support bar during the exercise session.

19. The device of claim 1, wherein the alert is at least one of an audio alert, a voice message alert, and a vibration alert.

* * * * *